US009026032B2

(12) United States Patent
Tsuchiya

(10) Patent No.: US 9,026,032 B2
(45) Date of Patent: May 5, 2015

(54) MEMBER MOVING MECHANISM AND IMAGE FORMING APPARATUS

(71) Applicant: KYOCERA Document Solutions Inc., Osaka (JP)

(72) Inventor: Hiroaki Tsuchiya, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/039,364

(22) Filed: Sep. 27, 2013

(65) Prior Publication Data

US 2014/0029997 A1 Jan. 30, 2014

Related U.S. Application Data

(63) Continuation of application No. 13/093,179, filed on Apr. 25, 2011, now Pat. No. 8,565,636.

(30) Foreign Application Priority Data

Apr. 27, 2010 (JP) ..... 2010-101965

(51) Int. Cl.

| | |
|---|---|
| ***G03G 15/00*** | (2006.01) |
| ***G03G 21/16*** | (2006.01) |
| ***G03G 15/08*** | (2006.01) |

(52) U.S. Cl.

CPC .... *G03G 15/6529* (2013.01); *G03G 2215/0897* (2013.01); *G03G 21/169* (2013.01); *G03G 21/1633* (2013.01); *G03G 15/0855* (2013.01)

(58) Field of Classification Search

CPC ..... A47B 21/02; A47B 47/04; A47B 51/00; A47B 88/06; A47F 3/00; D05B 75/06

See application file for complete search history.

(56) References Cited

U.S. PATENT DOCUMENTS

| | | | | |
|---|---|---|---|---|
| 4,239,566 | A * | 12/1980 | Howerton | 156/137 |
| 4,262,999 | A | 4/1981 | Sato et al. | |
| 6,152,205 | A * | 11/2000 | Toti | 160/84.04 |
| 7,542,699 | B2 * | 6/2009 | Kawasaki | 399/110 |
| 2007/0140763 | A1 * | 6/2007 | Shimizu et al. | 399/358 |
| 2008/0034909 | A1 | 2/2008 | Ishii | |
| 2008/0168681 | A1 | 7/2008 | Andersen et al. | |
| 2010/0266311 | A1 | 10/2010 | Igarashi | |

FOREIGN PATENT DOCUMENTS

| | | |
|---|---|---|
| JP | 06175222 | 6/1994 |
| JP | 08262947 | 10/1996 |
| JP | 10123888 | 5/1998 |
| JP | 11174890 | 7/1999 |

(Continued)

*Primary Examiner* — Clayton E Laballe
*Assistant Examiner* — Victor Verbitsky
(74) *Attorney, Agent, or Firm* — Dilworth & Barrese, LLP.

(57) ABSTRACT

A member moving mechanism according to the present invention includes: a first moving member that moves in a first positive direction and a first negative direction opposite to the first positive direction; a second moving member that moves in a second positive direction that is different from each of the first positive direction and the first negative direction, and in a second negative direction opposite to the second positive direction; a belt member that connects the first moving member and the second moving member; and a belt-member guiding member that controls a moving direction of the belt member, and changes the moving direction of the belt member at least once.

9 Claims, 15 Drawing Sheets

(56) References Cited

FOREIGN PATENT DOCUMENTS

| | | |
|---|---|---|
| JP | 2000196796 | 7/2000 |
| JP | 2003195578 | 7/2003 |
| JP | 2005-091482 | 4/2005 |
| JP | 2007248747 | 9/2007 |
| JP | 2008178687 | 8/2008 |
| JP | 2009058778 | 3/2009 |
| JP | 2010085432 | 4/2010 |

* cited by examiner

MEMBER MOVING MECHANISM AND IMAGE FORMING APPARATUS

This application is based on and claims the benefit of priority from Japanese Patent Application No. 2010-101965, filed on Apr. 27, 2010, and is a continuation of U.S. patent application Ser. No. 13/093,179, filed on Apr. 25, 2011, the content of each of which is incorporated herein by reference.

BACKGROUND OF THE INVENTION

1. Field of the Invention

The present invention relates to a member moving mechanism that connects two members and moves one member so as to cause another member to move, and to an image forming apparatus such as a printer, which includes the member moving mechanism.

2. Related Art

Image forming apparatuses such as printers may have a mechanism (member moving mechanism), in which a member provided inside a housing of an image forming apparatus is moved in conjunction with opening of a cover member. In such a member moving mechanism, a link or wire is used as a connection member connecting two members. With such a member moving mechanism, it is possible to move one member so as to cause another member to move via the connecting member.

SUMMARY OF THE INVENTION

However, since a member moving mechanism using a link is formed substantially of a rigid body, it has a lower degree of freedom in disposing the link.

On the other hand, a member moving mechanism using a wire, which is superior in flexibility, has a higher degree of freedom in disposing the wire. However, it is difficult to fix a flexural direction of the wire. As a result, when the member moving mechanism is assembled during manufacturing of an image forming apparatus, cases may occur where it is complicated to install the wire.

Therefore, there has been a demand that a member moving mechanism, which connects two members and moves one member in order to cause another member to move, satisfies the following requirements: a degree of freedom in disposing a connecting member is higher and the connecting member is more easily installed when the member moving mechanism is assembled.

Similarly, there has been such a demand in technical fields other than that of an image forming apparatus.

The present invention provides a member moving mechanism, which connects two members and moves one member in order to cause another member to move, having features that a degree of freedom is higher in disposing a connecting member and the connecting member is more easily installed when the member moving mechanism is assembled.

Moreover, the present invention provides an image forming apparatus including the member moving mechanism.

The present invention relates to a member moving mechanism, which includes a first moving member, a second moving member, a belt member and a belt-member guiding member. The first moving member is configured to move in a first positive direction and in a first negative direction opposite to the first positive direction. The second moving member is configured to move in a second positive direction differing from each of the first positive direction and the first negative direction, and in a second negative direction opposite to the second positive direction. The belt member is configured to connect the first moving member and the second moving member. The belt-member guiding member is configured to control a moving direction of the belt member and to change the moving direction of the belt member at least once.

According to the present invention, it is possible to provide a member moving mechanism, which connects two members and moves one member in order to cause another member to move, having features that a degree of freedom is higher in disposing a connecting member and the connecting member is more easily installed when the member moving mechanism is assembled.

Moreover, according to the present invention, it is possible to provide an image forming apparatus including the member moving mechanism.

DETAILED DESCRIPTION OF THE INVENTION

An embodiment of the present invention will be hereinafter described with reference to the attached drawings.

Figure 1:
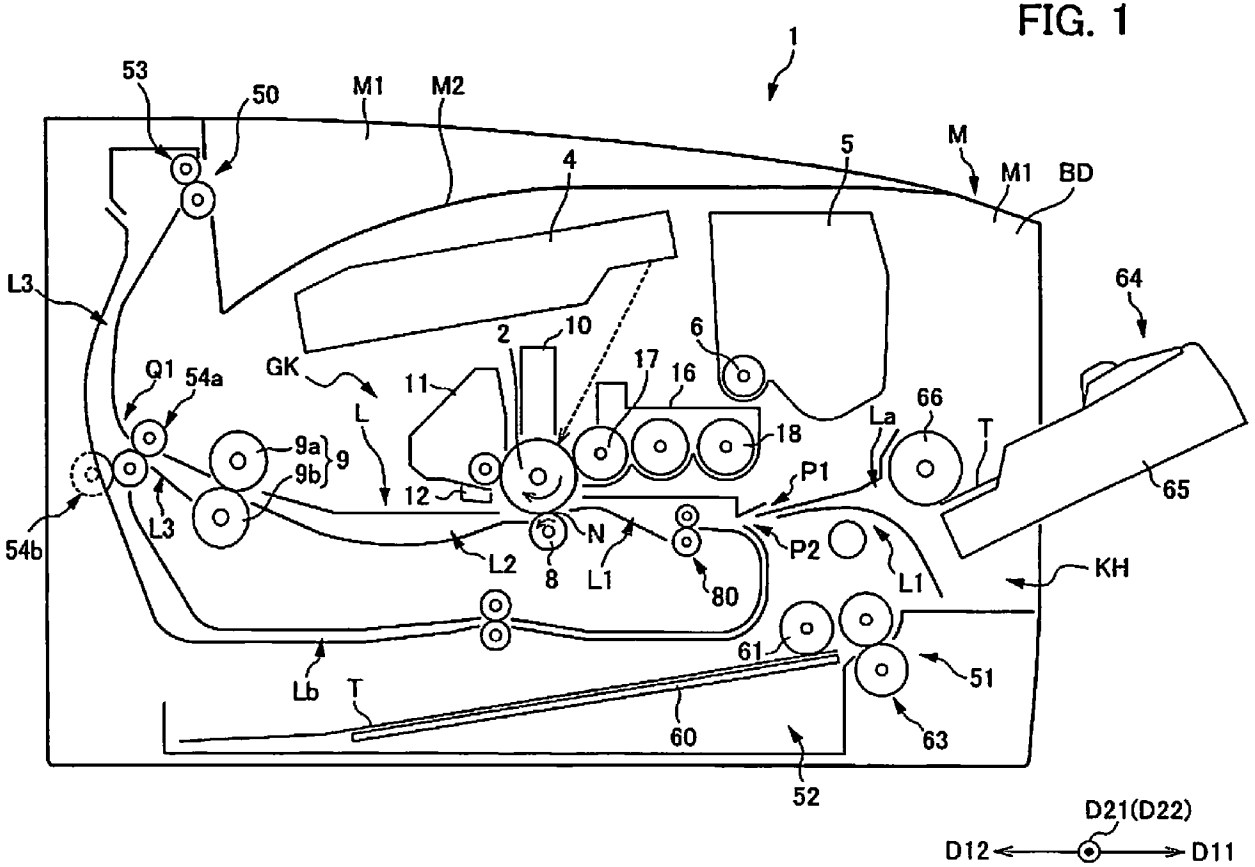
FIG. 1 is a view showing an arrangement of components of a printer 1 as one embodiment of an image forming apparatus of the present invention.
Figure 2:
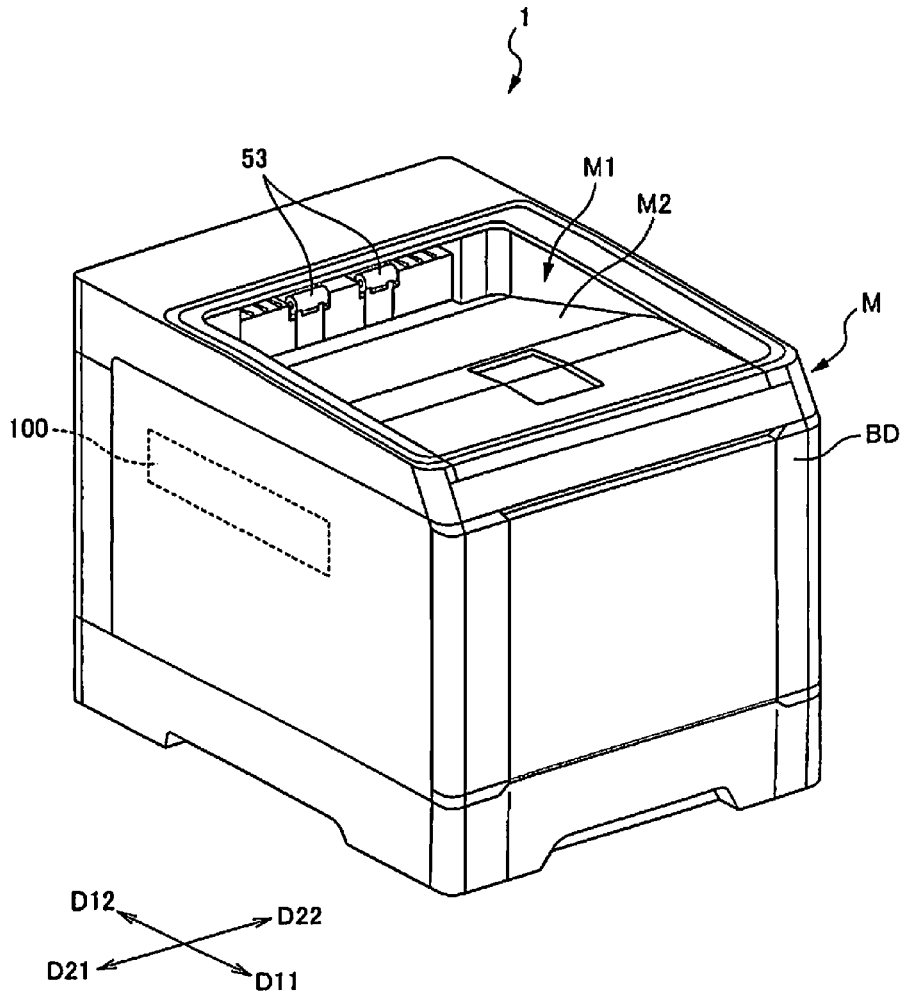
FIG. 2 is a perspective view showing an external appearance of the printer 1.

With reference to FIGS. 1 and 2, a description is provided for an entire structure of a printer 1 as one embodiment of an image forming apparatus of the present invention. FIG. 1 is a view showing an arrangement of components of the printer 1 as one embodiment of the image forming apparatus of the present invention. FIG. 2 is a perspective view showing an external appearance of the printer 1.

As shown in FIGS. 1 and 2, the printer 1 as one embodiment of the image forming apparatus of the present invention has an apparatus main unit M, an image forming unit GK, and a paper feeding/discharging portion KH. The image forming unit GK forms a predetermined toner image on a sheet of paper T as a sheet-like transfer material, based on predetermined image information. The paper feeding/discharging portion KH feeds the sheet of paper T to the image forming unit GK, and discharges the sheet of paper T on which a toner image has been formed.

An external shape of the apparatus main unit M is configured with a cabinet BD as its housing.

As shown in FIG. 1, the image forming unit GK includes a photosensitive drum 2 as an image carrier (photosensitive body), a charging unit 10, a laser scanner unit 4 as an exposure unit, a developing unit 16, a toner cartridge 5, a toner supply unit 6, a drum-cleaning unit 11, a neutralization unit 12, a transfer roller 8, and a fixing part 9.

As shown in FIG. 1, the paper feeding/discharging portion KH includes a paper feed cassette 52, a manual paper feed unit 64, a conveyance path L of a sheet of paper T, a pair of resisting rollers 80, and a paper discharging unit 50.

Configurations of the image forming unit GK and the paper feeding/discharging portion KH will be hereinafter described in detail.

First, the image forming unit GK is described.

Charging by the charging unit 10, exposure by the laser scanner unit 4, development by the developing unit 16, transfer by the transfer roller 8, and neutralization by the neutralization unit 12 are sequentially performed in order from upstream to downstream along a surface of the photosensitive drum 2 in the image forming unit GK.

The photosensitive drum 2 is configured with a cylindrical member and functions as a photosensitive body or an image carrier. The photosensitive drum 2 is disposed rotatable around an axis extending in a direction orthogonal to a direction in which a sheet of paper T is conveyed through the conveyance path L, in a direction indicated by an arrow. An electrostatic latent image may be formed on the surface of the photosensitive drum 2.

The charging unit 10 is disposed to face the surface of the photosensitive drum 2. The charging unit 10 negatively or positively charges the surface of the photosensitive drum 2 uniformly (with negative or positive polarity).

The laser scanner unit 4 functions as an exposure unit, and is disposed spaced apart from the surface of the photosensitive drum 2. The laser scanner unit 4 is composed of a laser light source, a polygon mirror, a polygon mirror driving motor and the like, none of which are illustrated in the drawings.

The laser scanner unit 4 scans and exposes the surface of the photosensitive drum 2 based on image information that is input from an external device such as a personal computer (PC). By being scanned and exposed by the laser scanner unit 4, an electric charge in an exposed portion on the surface of the photosensitive drum 2 is removed. In this way, an electrostatic latent image is formed on the surface of the photosensitive drum 2.

The developing unit 16 is provided in correspondence with the photosensitive drum 2, and is disposed to face the surface of the photosensitive drum 2. The developing unit 16 causes single color toner (black toner in general) to adhere to an electrostatic latent image formed on the photosensitive drum 2, thereby forming a single color toner image on the surface of the photosensitive drum 2. The developing unit 16 is composed of a developing roller 17 disposed to face the surface of the photosensitive drum 2, an agitation roller 18 for agitating toner, and the like.

The toner cartridge 5 is provided in correspondence with the developing unit 16, and stores toner to be supplied to the developing unit 16.

The toner supply unit 6 is provided in correspondence with the toner cartridge 5 and the developing unit 16, and supplies the toner stored in the toner cartridge 5 to the developing unit 16.

The toner supply unit 6 and the developing unit 16 are connected with each other via a toner feed passage that is not illustrated in the drawings.

The transfer roller 8 transfers a toner image, which has been developed on the surface of the photosensitive drum 2, onto a sheet of paper T. A transfer bias application unit (not shown) applies a transfer bias to the transfer roller 8 for transferring the toner image formed on the photosensitive drum 2 onto the sheet of paper T. The transfer roller 8 is configured to be rotatable while abutting the photosensitive drum 2.

The sheet of paper T conveyed through the conveyance path L is interposed between the photosensitive drum 2 and the transfer roller 8. The interposed sheet of paper T is pressed against the surface of the photosensitive drum 2. A transfer nip N is formed between the photosensitive drum 2 and the transfer roller 8. In the transfer nip N, the toner image developed on the photosensitive drum 2 is transferred onto the sheet of paper T.

The neutralization unit 12 is disposed to face the surface of the photosensitive drum 2. By irradiating light on the surface of the photosensitive drum 2, the neutralization unit 12 discharges electricity (neutralizes electrical charge) on the surface of the photosensitive drum 2, onto which the transfer has been performed.

The drum cleaning unit 11 is disposed to face the surface of the photosensitive drum 2. The drum cleaning unit 11 removes toner and attached matter remaining on the surface of the photosensitive drum 2, and conveys the toner and the like thus removed to a predetermined collecting mechanism for collection thereof.

By melting and pressurizing the toner that forms the toner image transferred onto the sheet of paper T, the fixing part 9 fixes the toner on the sheet of paper T. The fixing part 9 includes a heating rotor 9*a* to be heated by a heater, and a pressing rotor 9*b* to be pressed against the heating rotor 9*a*. The heating rotor 9*a* and the pressing rotor 9*b* interpose, press and convey the sheet of paper T on which the toner image has been transferred. The sheet of paper T is conveyed while interposed between the heating rotor 9*a* and the pressing rotor 9*b*. Accordingly, the toner transferred onto the sheet of paper T is melted and pressed, so that it is fixed on the sheet of paper T.

Next, the paper feeding/discharging portion KH is described.

As shown in FIG. 1, a paper cassette 52 for storing sheets of paper T is disposed in a lower portion of the apparatus main unit M. The paper cassette 52 is configured to be horizontally withdrawable from a right side (right side in FIG. 1) of the apparatus main unit M. A placing board 60 for placing the sheets of paper T is disposed in the paper cassette 52. The paper cassette 52 stores the sheets of paper T stacked on the placing board 60.

A sheet of paper T placed on the placing board 60 is fed to the conveyance path L by a cassette paper feed unit 51 that is disposed at an end portion on a paper-feeding side in the paper cassette 52 (an end portion on the right in FIG. 1). The cassette paper feed unit 51 includes a double-feed prevention mechanism that is composed of a forward feed roller 61 for picking up the sheet of paper T from the placing board 60, and a pair of feed rollers 63 for feeding the sheet of paper T to the conveyance path L on a sheet by sheet basis.

A manual paper feed unit 64 is provided on the right side (right side in FIG. 1) in the apparatus main unit M. The manual paper feed unit 64 is provided to the apparatus main unit M mainly for the purpose of supplying other sheets of paper T of sizes or types different from those of the sheets of paper T that are set in the paper cassette 52. The manual paper feed unit 64 includes a manual feed tray 65 and a paper feed roller 66 composing a part of the front face of the apparatus main unit M when the manual feed unit 64 is closed. A bottom edge of the manual feed tray 65 is attached pivotable (openable and closable) to the vicinity of the paper feed roller 66. The sheets of paper T are placed on the manual feed tray 65 when it is open. The paper feed roller 66 feeds the sheet of paper T placed on the manual feed tray 65 when it is open to a manual feed conveyance path La.

A paper discharging unit 50 is provided at an upper portion of the apparatus main unit M. The paper discharging unit 50 discharges the sheet of paper T to outside the apparatus main unit M by a pair of third rollers 53. Details of the paper discharging unit 50 will be described later.

The conveyance path L for conveying the sheet of paper T includes: a first conveyance path L1 from the cassette paper feed unit 51 to the transfer nip N; a second conveyance path L2 from the transfer nip N to the fixing part 9; a third conveyance path L3 from the fixing part 9 to the paper discharging unit 50; the manual feed conveyance path La that causes a sheet of paper supplied from the manual paper feed unit 64 to join the first conveyance path L1; and a returning conveyance path Lb. The returning conveyance path Lb is where the paper conveyed from downstream to upstream through the third conveyance path L3 is reversed and then returned to the first conveyance path L1.

Moreover, a first joining portion P1 and a second joining portion P2 are provided somewhere along the first conveyance path L1. A first branching portion Q1 is provided somewhere along the third conveyance path L3.

The first joining portion P1 is where the first manual feed conveyance path La joins the conveyance path L1. The second joining portion P2 is where the returning conveyance path Lb joins the first conveyance path L1.

The first branching portion Q1 is where the returning conveyance path Lb branches off the third conveyance path L3. In addition, the first branching portion Q1 has a pair of first rollers 54*a* and a pair of second rollers 54*b*. The same roller concurrently serves as one of the pair of first rollers 54*a* and one of the pair of second rollers 54*b*.

A sensor for detecting a sheet of paper T as well as the pair of resisting rollers 80 are disposed somewhere along the first conveyance path L1 (more specifically, between the second joining portion P2 and the transfer roller 8). The sensor is disposed immediately before the pair of resisting rollers 80 in a direction of conveying the sheet of paper T (upstream in the conveyance direction). The pair of resisting rollers 80 is a pair of rollers for correcting skew (diagonal paper feed) of the sheet of paper T, and for adjusting timing of feeding the sheet of paper T with respect to the formation of a toner image in the image forming unit GK. The pair of resisting rollers 80 performs the aforementioned correction and timing adjustment based on information related to detection signals sent from the sensor and conveys the sheet of paper T.

The returning conveyance path Lb is a conveyance path provided for the purpose of causing another surface (unprinted surface) opposite to a surface that has already been printed to face the photosensitive drum 2 when duplex printing is performed on the sheet of paper T.

With the returning conveyance path Lb, it is possible to reverse and return the sheet of paper T, which is conveyed from the first branching portion Q1 to the paper discharging unit 50 by the pair of first rollers 54*a*, to the first conveyance path L1 by the second pair of rollers 54*b*. In addition, it is possible to convey the sheet of paper T to upstream of the pair of resisting rollers 80 disposed on upstream of the transfer roller 8. In the transfer nip N, a predetermined toner image is transferred onto an unprinted surface of the sheet of paper T that has been reversed through the returning conveyance path Lb.

The paper discharging unit 50 is formed at the end portion of the third conveyance path L3. The paper discharging unit 50 is disposed at the upper portion of the apparatus main unit M. The paper discharging unit 50 is open toward the right side (right side in FIG. 1, and a side closer to the manual paper feed unit 64) of the apparatus main unit M. The paper discharging unit 50 discharges the sheet of paper T conveyed through the third conveyance path L3 to outside the apparatus main unit M by the pair of third rollers 53.

A discharged paper accumulating portion M1 is formed on an opening side of the paper discharging unit 50. The discharged paper accumulating portion M1 is formed on a top face (outer face) of the apparatus main unit M. The discharged paper accumulating portion M1 is where the top face of the apparatus main unit M is formed to be recessed downward. A bottom face of the discharged paper accumulating portion M1 is formed of a top cover member M2 as an opening and closing member, which composes a part of the top face of the apparatus main unit M. The sheet of paper T on which a predetermined toner image has been formed and that has been discharged from the paper discharging unit 50 is stacked and accumulated on the top face of the top cover member M2 that forms the discharged paper accumulating portion M1. The top cover member M2 is openable and closable about the rotational shaft 172 (shown in FIG. 7) which is parallel to an axis of the photosensitive drum 2. The toner cartridge 5 is detachable from and attachable to the cabinet BD via an opening provided by opening of the top cover member M2.

It should be noted that a sensor for detecting a sheet of paper is disposed in a predetermined position of each conveyance path.

As shown in FIG. 2, a member moving mechanism 100 that operates in conjunction with opening and closing of the top cover member M2 is incorporated inside the apparatus main unit M of the printer 1 according to the present embodiment. The member moving mechanism 100 will be described later.

Next, operations of the printer 1 of the present embodiment will be briefly described with reference to FIG. 1.

First, a case of performing single-side printing on a sheet of paper T stored in the paper cassette 52 is described.

The sheet of paper T stored in the paper cassette 52 is fed to the first conveyance path L1 by the forward feed roller 61 and the pair of feed rollers 63, and is subsequently conveyed through the first joining portion P1 and the first conveyance path L1 to the pair of resisting rollers 80.

The pair of resisting rollers 80 performs skew correction of the sheet of paper T and adjustment of timing with a toner image.

The sheet of paper T discharged from the pair of resisting rollers 80 is introduced between the photosensitive drum 2 and the transfer roller 8 (i.e. in the transfer nip N) through the first conveyance path L1. In addition, a toner image is transferred onto the sheet of paper T between the photosensitive drum 2 and the transfer roller 8.

Subsequently, the sheet of paper T is discharged from between the photosensitive drum 2 and the transfer roller 8, and is introduced to a fixing nip between the heating rotor 9*a* and the pressing rotor 9*b* in the fixing part 9 through the second conveyance path L2. In the fixing nip, toner is melted and fixed on the sheet of paper T.

Subsequently, the sheet of paper T is conveyed through the third conveyance path L3 to the paper discharging unit 50 by the pair of first rollers 54*a*, and is discharged from the paper discharging unit 50 to the discharged-paper accumulating portion M1 by the pair of third rollers 53.

In this way, the single-side printing of the sheet of paper T stored in the paper cassette 52 is completed.

In a case of performing single-side printing on a sheet of paper T placed on the manual feed tray 65, the sheet of paper T placed on the manual feed tray 65 is fed to the manual feed conveyance path La by the paper feed roller 66, and is subsequently conveyed through the first joining portion P1 and the first conveyance path L1 to the pair of resisting rollers 80. Subsequent operations are similar to the aforementioned operations of the single-side printing of the sheet of paper T stored in the paper cassette 52, and thus a description thereof is omitted.

Next, operations of the printer 1 in a case of performing duplex printing will be described.

As described above, in a case of the single-side printing, the printing operations are completed when the sheet of paper T on which single-side printing has been performed is discharged from the paper discharging unit 50 to the discharged-paper accumulating portion M1.

In contrast, in a case of performing duplex printing, the sheet of paper T on which single-side printing has been performed is reversed through the returning conveyance path Lb, and then conveyed again to the pair of resisting rollers 80. In this manner, duplex printing is performed on the sheet of paper T.

More specifically, the operations are similar to the operations of single-side printing as described above, until the sheet of paper T on which single-side printing has been performed is discharged from the paper discharging unit 50 by the pair of third rollers 53. However, in a case of duplex printing, the rotation of the pair of third rollers 53 is stopped and rotated in an opposite direction, while the sheet of paper T on which single-side printing has been performed is held by the pair of third rollers 53. When the pair of third rollers 53 is rotated in the opposite direction, the sheet of paper T held by the pair of third rollers 53 is conveyed to the opposite direction through the third conveyance path L3 (in a direction from the paper discharging unit 50 to the first branching portion Q1).

As described above, when the sheet of paper T is conveyed through the third conveyance path L3 in the opposite direction, the sheet of paper T is introduced between the pair of second rollers 54*b* (instead of the pair of first rollers 54*a*). The sheet of paper T then joins the first conveyance path L1 through the returning conveyance path Lb and the second joining portion P2. Here, the sheet of paper T has already been reversed from the single-side printing.

Furthermore, the correction or adjustment is performed on the sheet of paper T by the pair of resisting rollers 80. The sheet of paper T is introduced between the photosensitive drum 2 and the transfer roller 8 through the first conveyance path L1. As a result of the sheet of paper T passing through the returning conveyance path Lb, an unprinted surface of the sheet of paper T faces the photosensitive drum 2. A toner image is transferred onto the unprinted surface, and as a result, duplex printing is performed.

Next, details of a configuration of the member moving mechanism 100 of the present embodiment will be described with reference to FIGS. 3 to 6.

Figure 3:
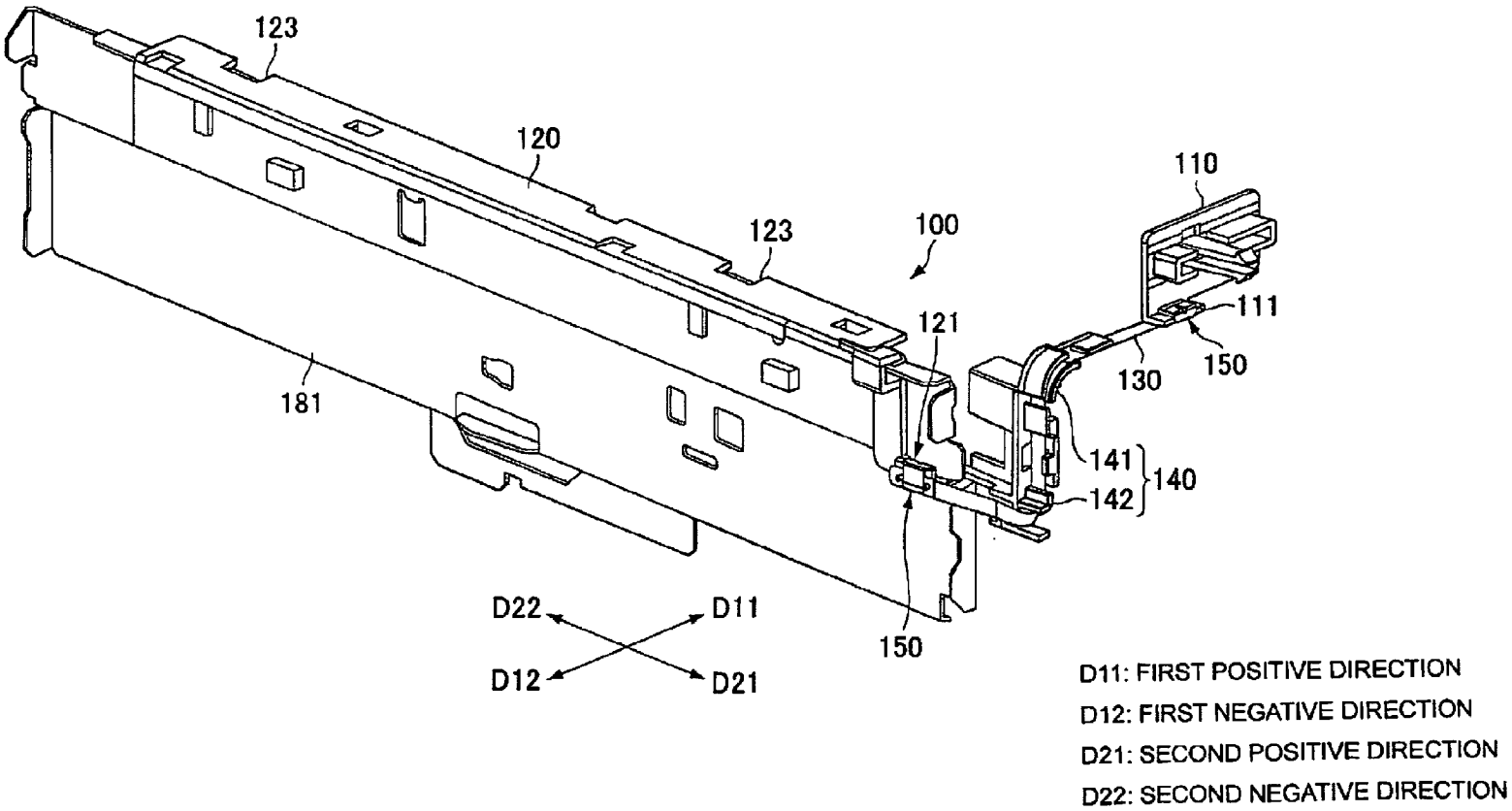
FIG. 3 is a perspective view showing an overall structure of a member moving mechanism 100 of the present embodiment.

FIG. 3 is a perspective view showing an overall structure of the member moving mechanism 100 of the present embodiment.

Figure 4:
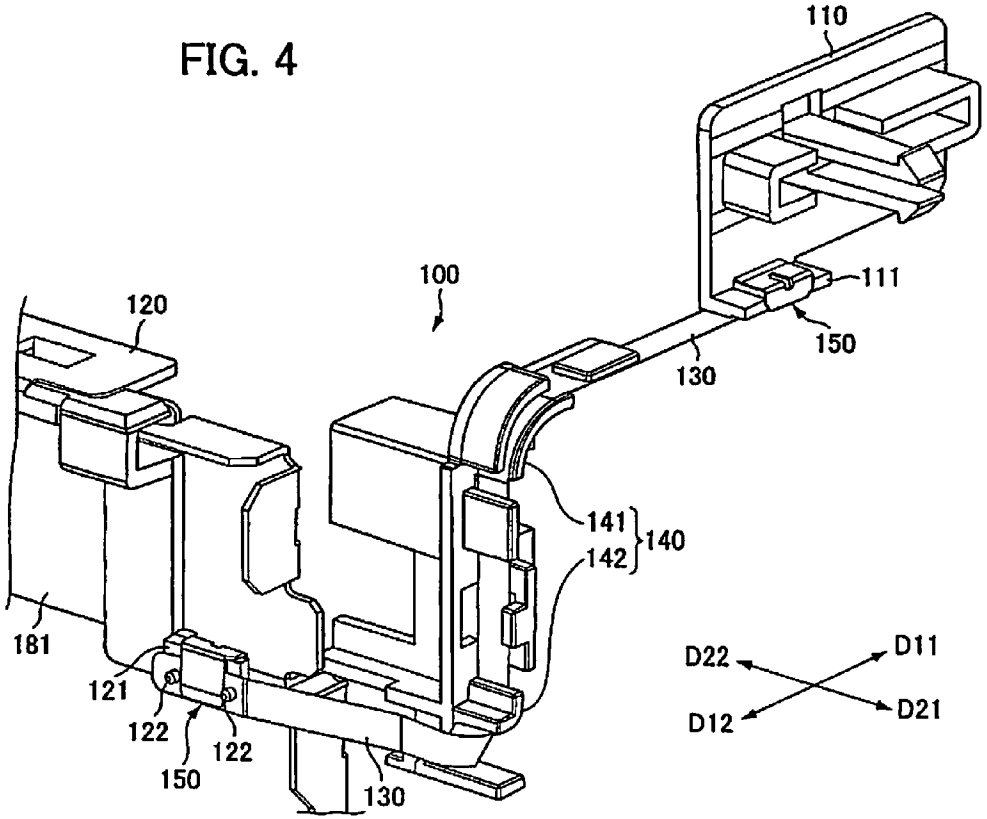
FIG. 4 is an enlarged perspective view of main portions of the member moving mechanism 100 of the present embodiment.

FIG. 4 is an enlarged perspective view of main portions of the member moving mechanism 100 of the present embodiment.

Figure 5:
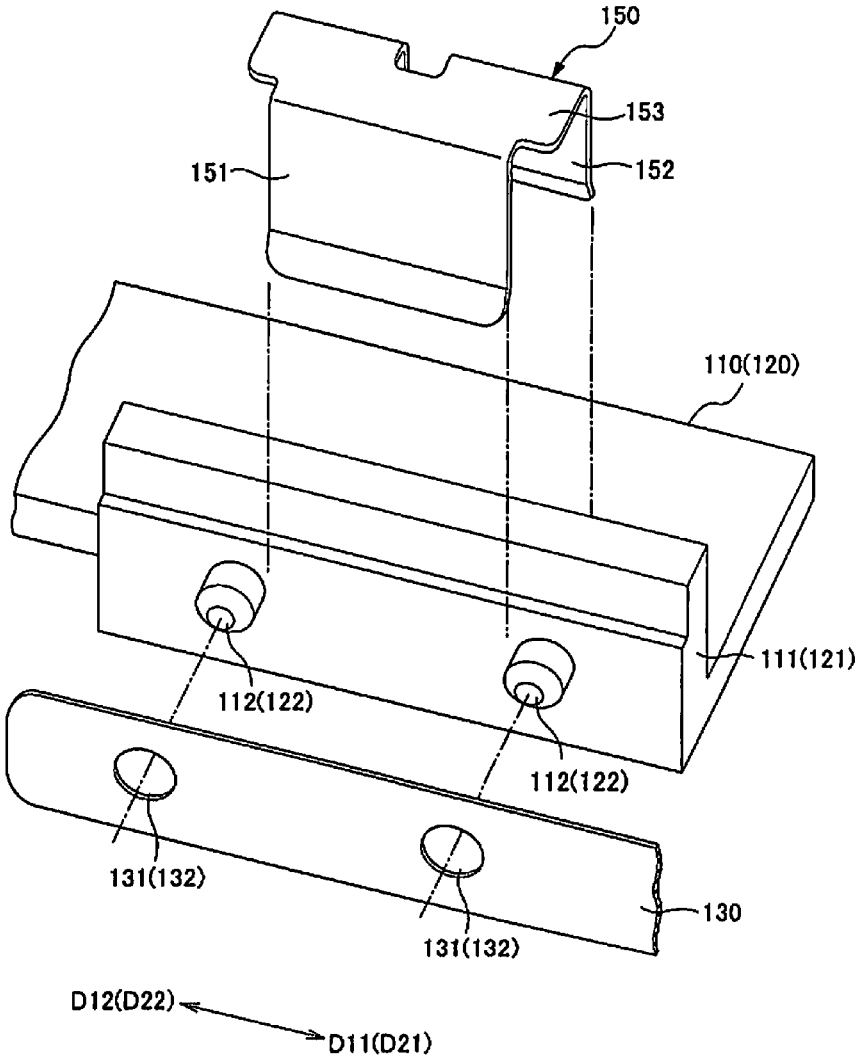
FIG. 5 is an enlarged perspective view of main portions showing in exploded view a structure of a connecting portion between first and second moving members 110 and 120 and a belt member 130 in the member moving mechanism 100 of the present embodiment.
Figure 6:
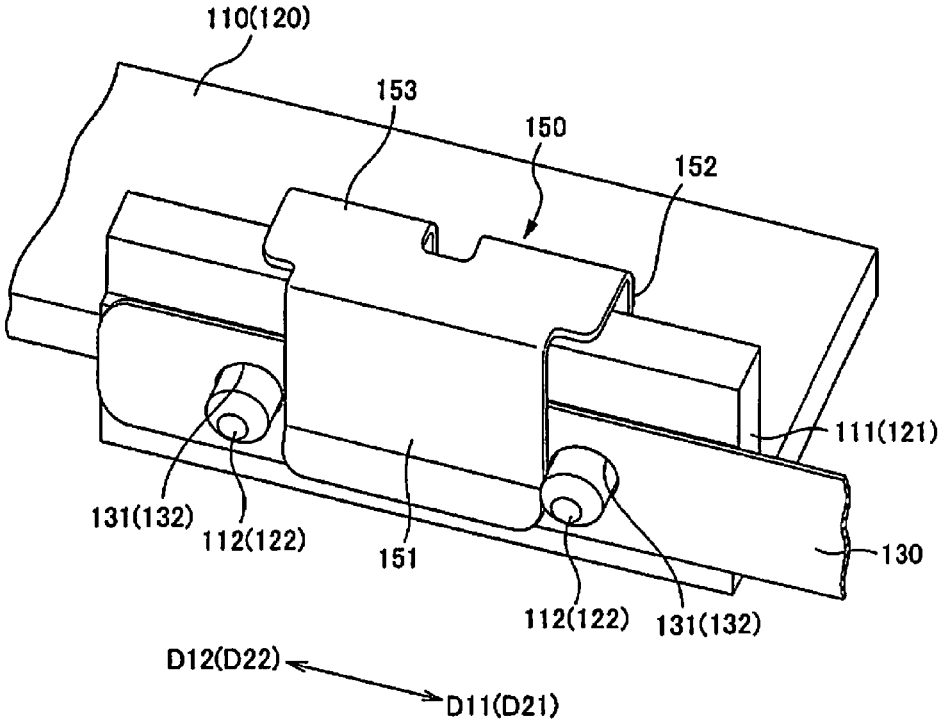
FIG. 6 is an enlarged exploded perspective view of main portions showing in an assembled (connected) state a structure of the connecting portion between the first and second moving members 110 and 120 and the belt member 130 in the member moving mechanism 100 of the present embodiment.

FIG. 5 is an enlarged perspective view of main portions showing in exploded view of a structure of a connecting portion between first and second moving members 110 and 120 and a belt member 130 in the member moving mechanism 100 of the present embodiment. FIG. 6 is an enlarged exploded perspective view of main portions showing in an assembled (connected) state of a structure of the connecting portion between the first and second moving members 110 and 120 and the belt member 130 in the member moving mechanism 100 of the present embodiment.

As shown in FIGS. 3 and 4, the member moving mechanism 100 includes the first moving member 110, the second moving member 120, the belt member 130, and a belt-member guiding member 140.

The first moving member 110 is arranged at one end portion with respect to a front-back direction of the cabinet BD (direction perpendicular to the paper surface of FIG. 1), and moves in a first positive direction D11 and a first negative direction D12 (opposite to the first positive direction D11).

The second moving member 120 moves in directions different from each of the first positive direction D11 and the first negative direction D12. More specifically, the second moving member 120 moves in a second positive direction D21 (orthogonal to the first positive direction D11 and the first negative direction D12 and parallel to the axis of the photosensitive drum 2) and a second negative direction D22 (opposite to the second positive direction D21).

The belt member 130 is a member like a belt that connects the first moving member 110 and the second moving member 120. The belt member 130 is formed of a flexible sheet-like material. Examples of the flexible sheet-like material may include a plastic material such as PET (polyethylene terephthalate), elastic material such as rubber, and metallic material. Thickness of the belt member 130 is, for example, no more than 1 mm.

The belt-member guiding member 140 that is disposed to interpose the belt member 130 in a thickness direction thereof restricts a direction in which the belt member 130 moves and changes the moving direction of the belt member 130 twice.

More specifically, the belt-member guiding member 140 is composed of an arc-shaped first guiding member 141 and a second guiding member 142. The first guiding member 141 is disposed to interpose front and back faces of the belt member 130. The first guiding member 141 changes the moving direction of the belt member 130 by substantially 90 degrees: from one moving direction in which the front and back faces of the belt member 130 move horizontally along a horizontal plane to another moving direction in which the front and back faces of the belt member 130 move downward along a vertical plane. The second guiding member 142 is disposed to face the front face of the belt member 130. The second guiding member 142 changes the moving direction of the belt member 130 by substantially 90 degrees: from a downward moving direction to a moving direction in which the front and back faces of the belt member 130 move horizontally along the vertical plane.

As shown in FIG. 5, two first holes 131 are formed longitudinally spaced at a first longitudinal end portion of the belt member 130. Two second holes 132 are formed longitudinally spaced at a second longitudinal end portion of the belt member 130.

A connected portion 111 of the first moving member 110 has two first protrusions 112 to be inserted into the first holes 131. A connected portion 121 of the second moving member 120 has two second protrusions 122 to be inserted into the second holes 132.

The first longitudinal end portion and the second longitudinal end portion of the belt member 130 have a similar configuration. Moreover, the connected portion 111 of the first moving member 110 and the connected portion 121 of the second moving member 120 have a similar configuration. Therefore, these portions are described in common with reference to FIGS. 5 and 6.

In addition, a connection retaining clip 150 is attached to the first longitudinal end portion of the belt member 130. The connection retaining clip 150 is elastically fitted to a connecting portion between the belt member 130 and the connected portion 111 of the first moving member 110. Similarly, another connection retaining clip 150 is attached to the second longitudinal end portion of the belt member 130. The other connection retaining clip 150 is elastically fitted to a connecting portion between the belt member 130 and the connected portion 121 of the second moving member 120.

The connection retaining clip 150 has a first plate portion 151, a second plate portion 152 and a plate connecting portion 153. The first plate portion 151 is in elastic contact with an outer face of the belt member 130 between the two first holes 131 or between the two second holes 132. The second plate portion 152 is in elastic contact with an inner face of the connected portion 111 or the connected portion 121. The plate connecting portion 153 connects the plate portions 151 and 152. The connection retaining clip 150 is made of a plate material for a spring with a bending process.

In addition, as shown in FIG. 6, the first protrusions 112 provided on the first moving member 110 are inserted into the first holes 131 of the belt member 130. Furthermore, the connection retaining clip 150 is elastically fitted to where the connected portion 111 of the first moving member 110 overlaps with the belt member 130. As a result, the first moving member 110 and the first end portion of the belt member 130 are connected with each other, and this connection is retained.

Similarly, the second protrusions 122 provided on the second moving member 120 are inserted into the second holes 132 of the belt member 130. Moreover, the other connection retaining clip 150 is elastically fitted to where the connected portion 121 of the second moving member 120 overlaps with the belt member 130. As a result, the second moving member 120 and the second end portion of the belt member 130 are connected with each other, and this connection is retained.

Next, a description will be provided for a structure linked between the top cover member M2 in the printer 1 and the member moving mechanism 100 that operates in conjunction with opening and closing of the top cover member M2. A description will be also provided for a structure linked between the member moving mechanism 100 and a cleaning member 190 connected to the second moving member 120 in the member moving mechanism 100.

Figure 7:
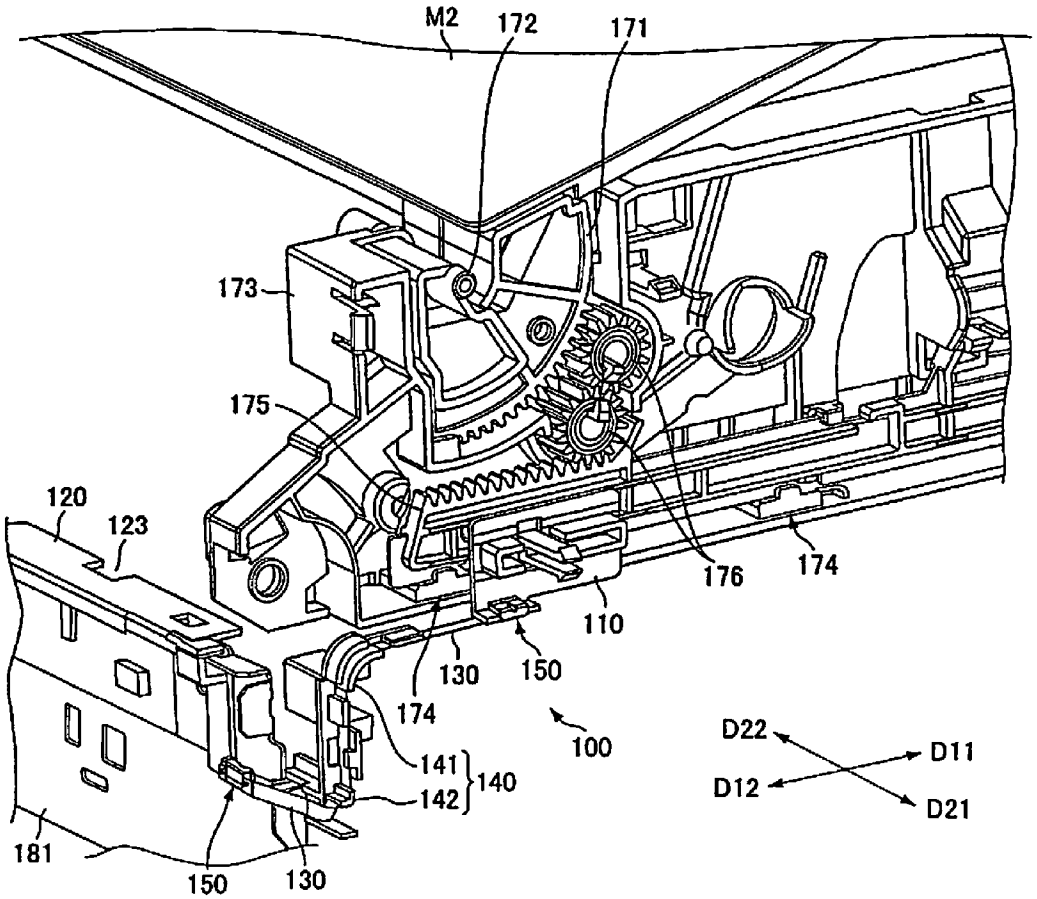
FIG. 7 is a perspective view showing details of a linkage structure between a top cover member M2 and the member moving mechanism 100 in the printer 1.
Figure 8:
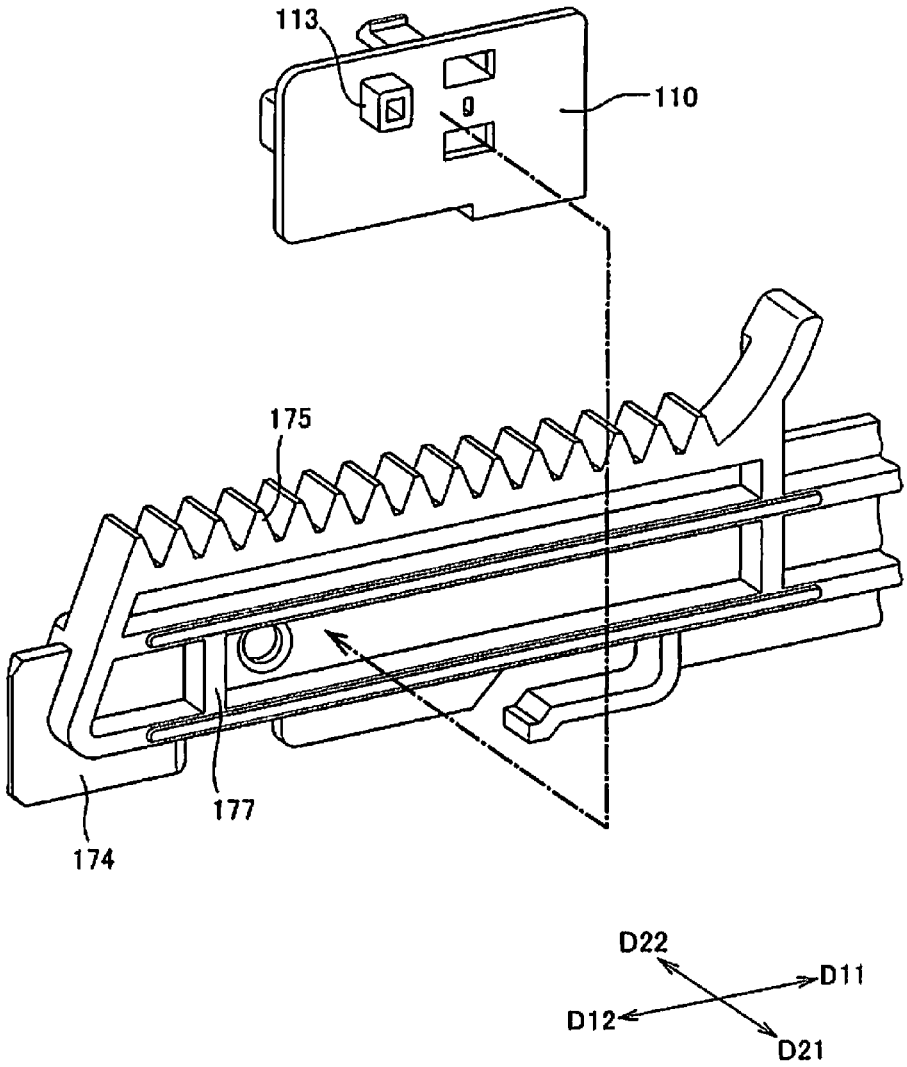
FIG. 8 is an enlarged perspective view of main portions showing in a deployed state a structure for moving the first moving member 110 in a first positive direction D11 in the member moving mechanism 100 of the present embodiment.
Figure 9:
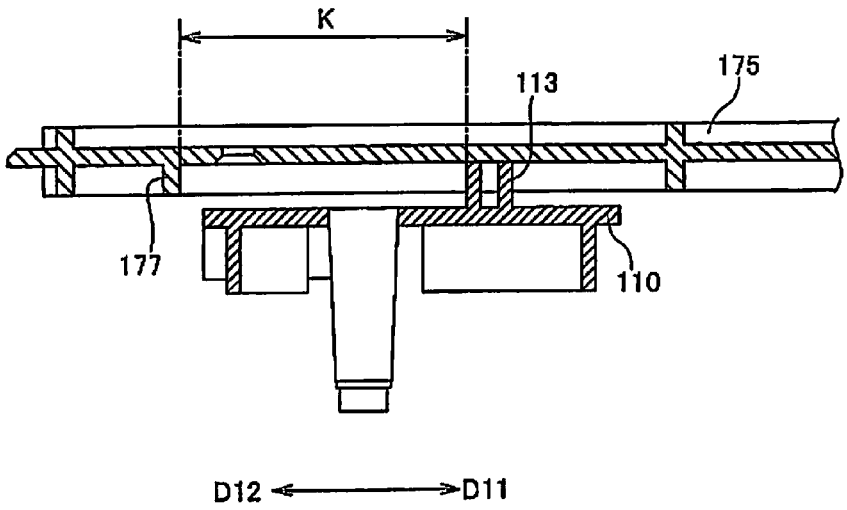
FIG. 9 is an enlarged cross-sectional plan view of the main portions illustrating the structure for moving the first moving member 110 in the first positive direction D11 in the member moving mechanism 100 of the present embodiment.
Figure 10:
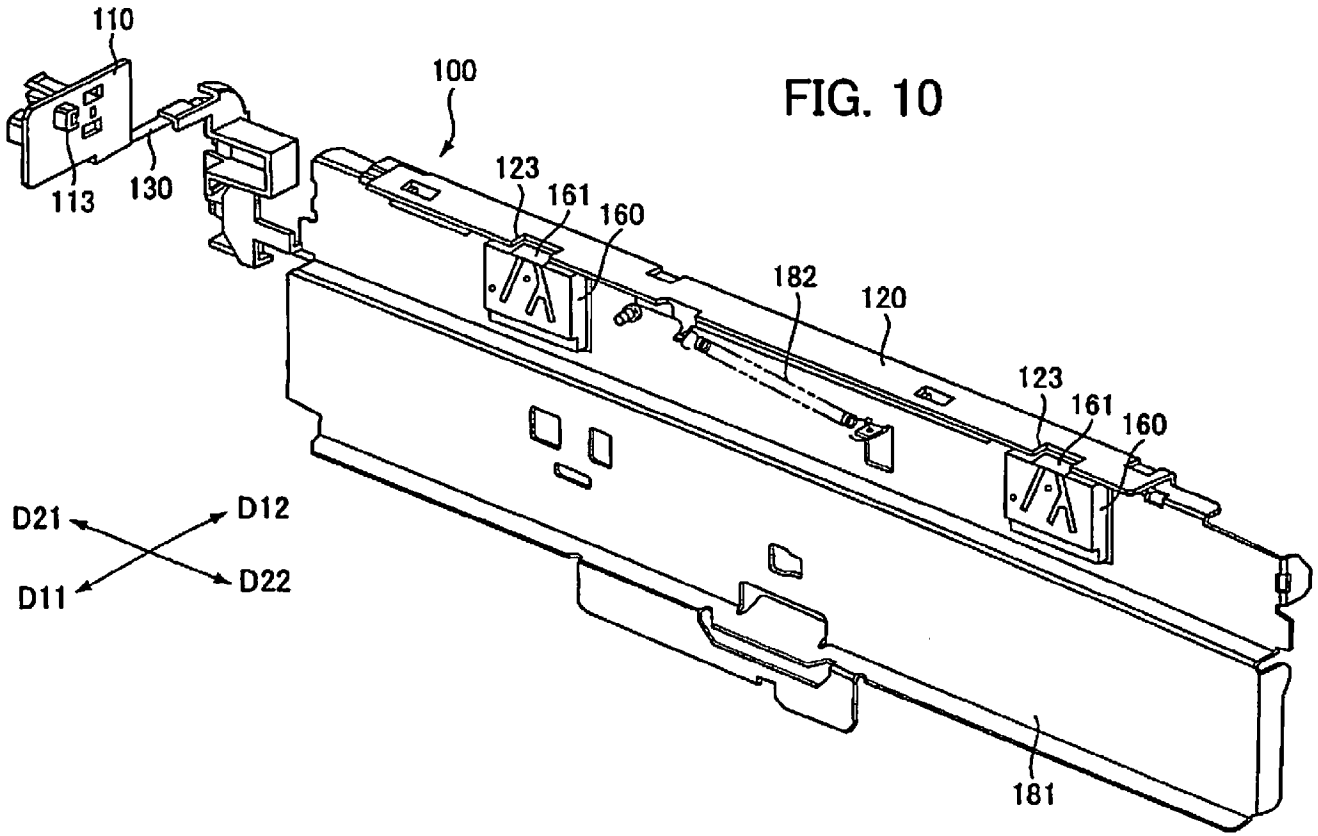
FIG. 10 is a perspective view showing the overall structure of the member moving mechanism 100 of the present embodiment, as viewed from a side opposite to FIG. 3.
Figure 11:
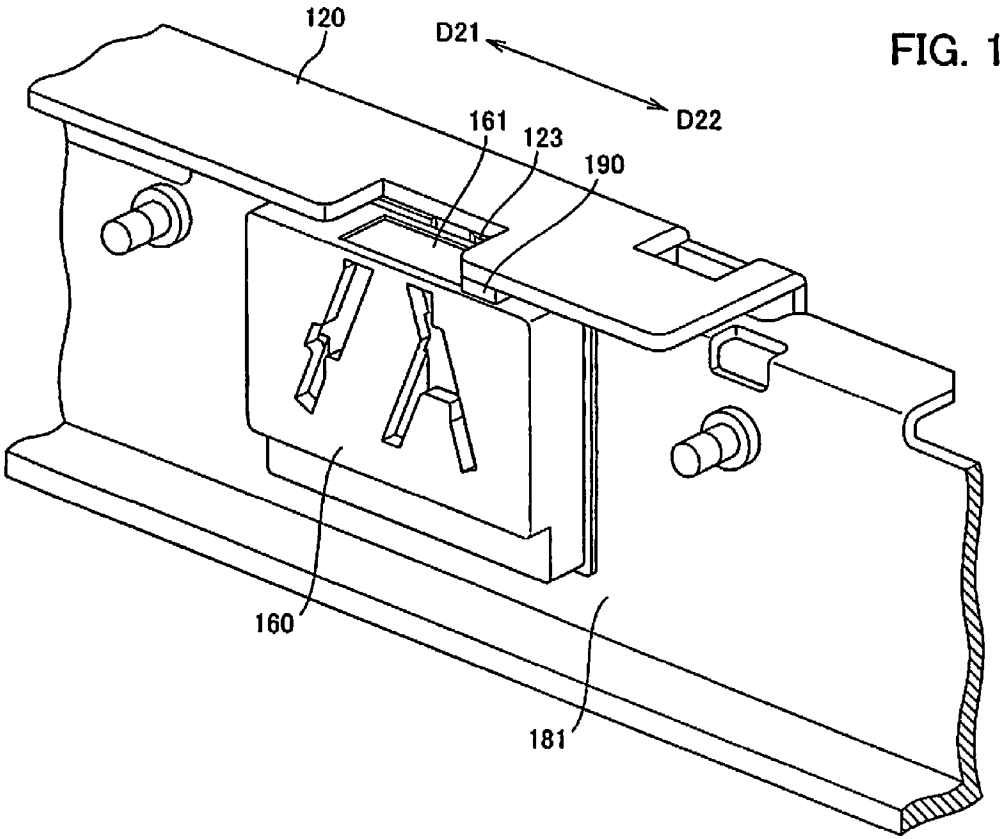
FIG. 11 is an enlarged perspective view of main portions illustrating a detailed configuration of a cleaning member 190 in the printer 1.

FIG. 7 is a perspective view showing details of the structure linked between the top cover member M2 and the member moving mechanism 100 in the printer 1. FIG. 8 is an enlarged perspective view of main portions showing in a deployed state of a structure for moving the first moving member 110 in the first positive direction D11 in the member moving mechanism 100 of the present embodiment. FIG. 9 is an enlarged cross-sectional plan view of main portions illustrating the structure for moving the first moving member 110 in the first positive direction D11 in the member moving mechanism 100 of the present embodiment. FIG. 10 is a perspective view showing the overall structure of the member moving mechanism 100 of the present embodiment, as viewed from a side opposite to FIG. 3. FIG. 11 is an enlarged perspective view of main portions illustrating a detailed configuration of the cleaning member 190 in the printer 1.

As shown in FIG. 7, a circumferential end portion of a gear segment 171, which is about ¼ in length of a full circular circumference, is integrally fixed to a base end portion of the top cover member M2. A rotational shaft 172 of the gear segment 171 is held by a first stationary frame 173. The first stationary frame 173 composes a part of a cabinet BD (the apparatus main unit M). The top cover member M2 is openable and closable about the rotational shaft 172 of the gear segment 171, relative to the cabinet BD (the apparatus main unit M).

A rail member 174 extending along the first positive direction D11 and the first negative direction D12 is formed on the first stationary frame 173. A rack 175 is held on the rail member 174. The rack 175 functions as a moving-force-giving member that gives a force to cause the first moving member 110 to move in the first positive direction D11. The rack 175 that engages with the gear segment 171 via a pair of intermediate gears 176 interlocks with the gear segment 171.

As shown in FIGS. 8 and 9, a first engagement portion 113 is provided to the first moving member 110 such that the first engagement portion 113 protrudes in a direction orthogonal to the first positive direction D11 and the first negative direction D12.

On the other hand, a second engagement portion 177 engaging with the first engagement portion 113 is provided on a side face of the rack 175. The first engagement portion 113 is configured not to engage with the second engagement portion 177 when the rack 175 starts moving, and to engage with the second engagement portion 177 when the rack 175 has moved a predetermined distance K in the first positive direction D11.

Since the member moving mechanism 100 is configured as described above, the rack 175 moves along the rail member 174 in the first positive direction D11 via the gear segment 171 and the pair of intermediate gears 176, in conjunction with opening of the top cover member M2. In addition, the first moving member 110 of the member moving mechanism 100 moves in the first positive direction D11 when the rack 175 further moves subsequent to the movement of the predetermined distance K in the first positive direction D11.

On the other hand, as shown in FIG. 10, the second moving member 120 that has a shape of an elongated plate is supported by a second stationary frame 181 to be movable in relation to the second stationary frame 181. The second stationary frame 181 composes a part of the cabinet BD (the apparatus main unit M). The second stationary frame 181 extends along the second positive direction D21 and the second negative direction D22 of the second moving member 120. As a biasing member that gives a biasing force to the second moving member 120, a coil spring 182 is stretched between the second stationary frame 181 and the second moving member 120. The coil spring 182 permits the second moving member 120 to move in the second positive direction D21 via the belt member 130, in conjunction with the first moving member 110 moving in the first positive direction D11. Moreover, the coil spring 182 generates a biasing force in a direction to cause the second moving member 120 to move back in the second negative direction D22, in conjunction with the second moving member 120 moving in the second positive direction D21.

As shown in FIGS. 10 and 11, an optical sensor 160, which is a member to be cleaned, is attached to the second stationary frame 181. The optical sensor 160 is a sensor that detects, for example, image density. The optical sensor 160 is fixed to the second stationary frame 181 such that a light transmission window 161 made of a transparent member is positioned on a top face thereof.

A cutout 123 is formed in the second moving member 120. The cutout 123 is formed in order not to block light emitted through the light transmission window 161 of the optical sensor 160 when the second moving member 120 is positioned at a normal origin (home position), i.e. when the top cover member M2 is closed. A wiper 190 is attached as a cleaning member to a bottom face of the second moving member 120 in the vicinity of the cutout 123.

Since the member moving mechanism 100 is configured as described above, the wiper 190 moves back and forth while touching the light transmission window 161 of the optical sensor 160, in conjunction with the second moving member 120 moving in the second positive direction D21 and the second negative direction D22. In this manner the wiper 190 performs cleaning of the light transmission window 161.

Next, with reference to FIGS. 12 to 15, a description will be provided for operations of the member moving mechanism 100 of the present embodiment, as well as operations linked via the member moving mechanism 100 between opening and closing of the top cover member M2 and cleaning performed by the wiper 190.

Figure 12:
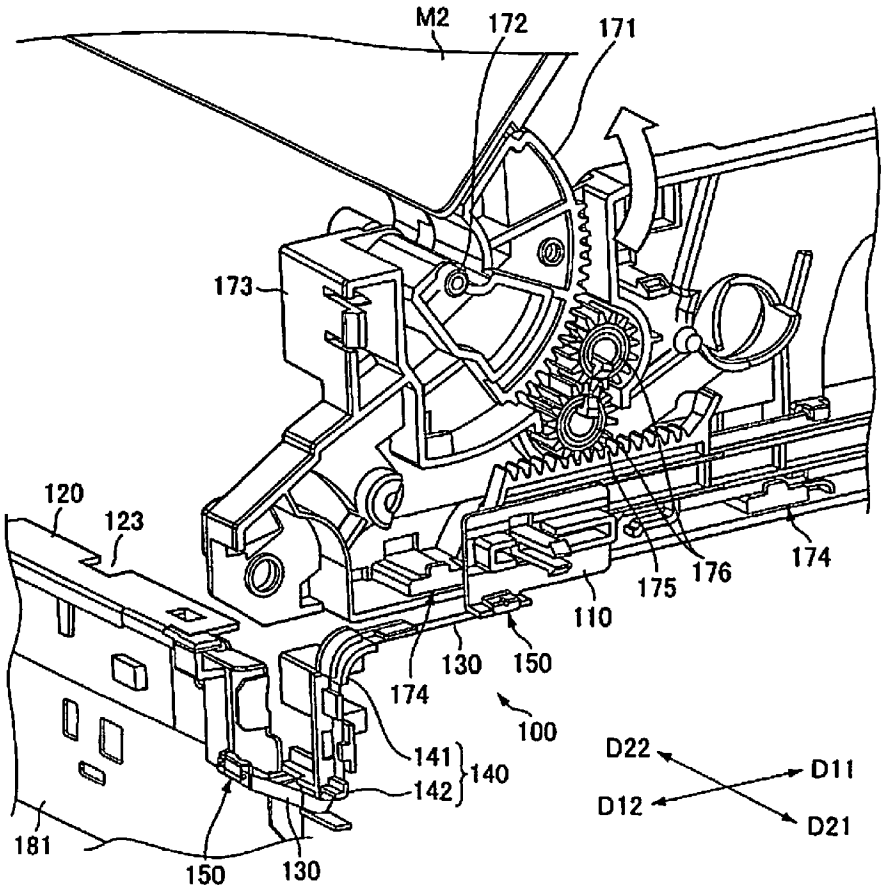
FIG. 12 is a perspective view showing a linked operation between the top cover member M2 and the member moving mechanism 100 when the top cover member M2 in the printer 1 has started to open.
Figure 13:
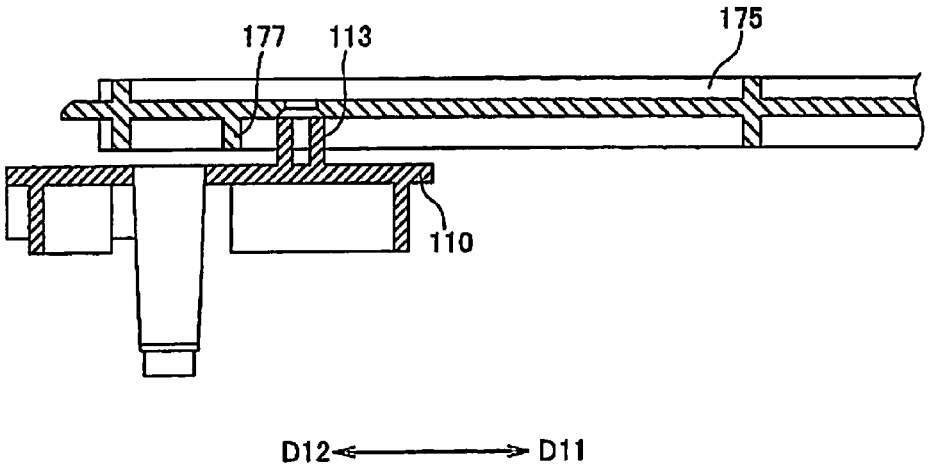
FIG. 13 is a cross-sectional plan view of main portions illustrating a linkage between the first moving member 110 and a rack 175 when the top cover member M2 in the printer 1 has started to open.
Figure 14:
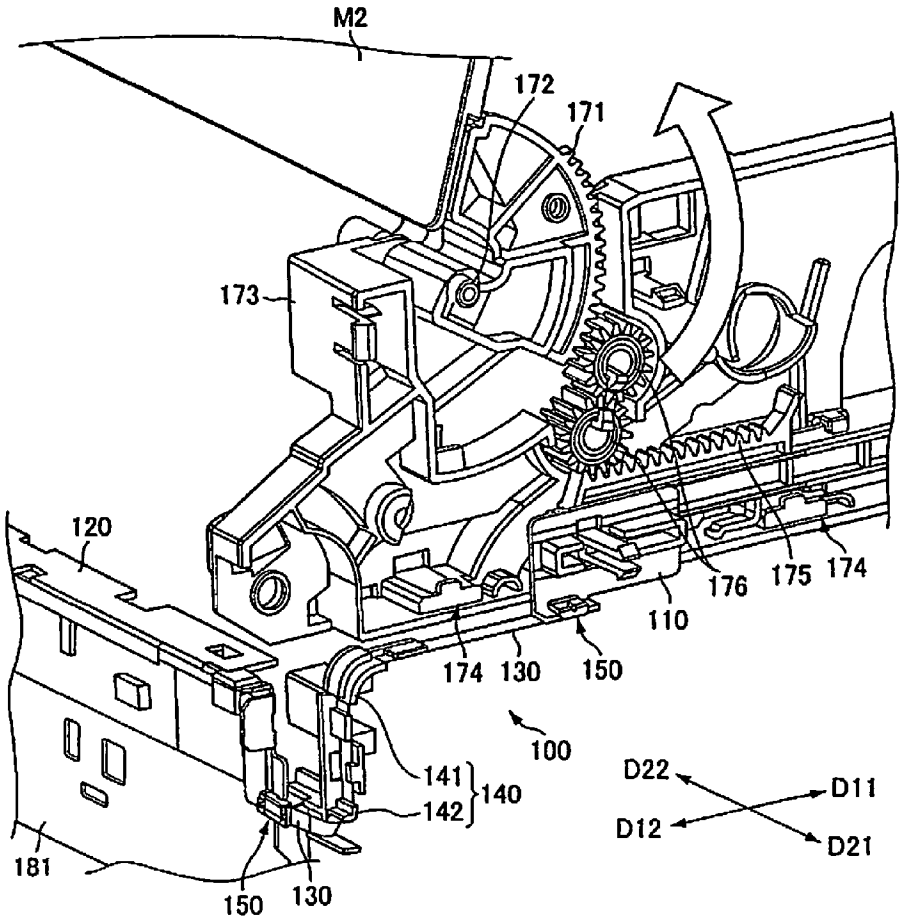
FIG. 14 is a perspective view showing a linked operation between the top cover member M2 and the member moving mechanism 100 when the top cover member M2 in the printer 1 has been maximally opened.
Figure 15:
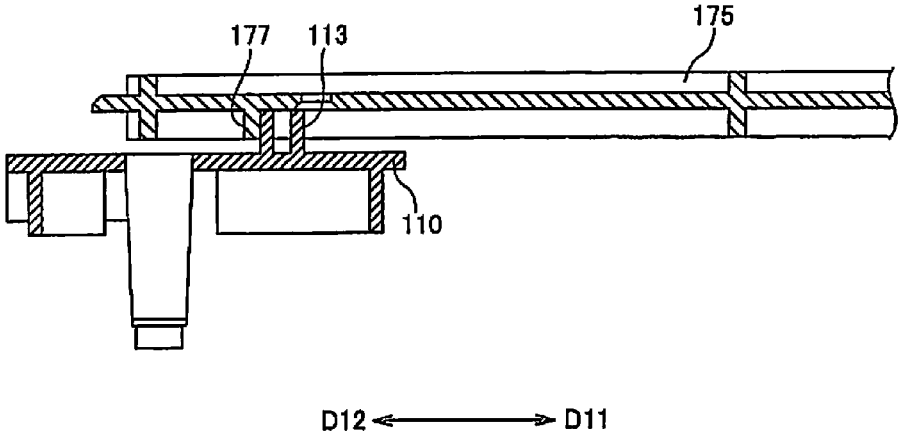
FIG. 15 is a cross-sectional plan view of the main portions illustrating a linkage between the first moving member 110 and the rack 175 when the top cover member M2 in the printer 1 has been maximally opened.

FIG. 12 is a perspective view showing an operation linked between the top cover member M2 and the member moving mechanism 100 when the top cover member M2 in the printer 1 has started to open. FIG. 13 is a cross-sectional plan view of main portions illustrating a linkage between the first moving member 110 and the rack 175 when the top cover member M2 in the printer 1 has started to open. FIG. 14 is a perspective view showing an operation linked between the top cover member M2 and the member moving mechanism 100 when the top cover member M2 in the printer 1 has been maximally opened. FIG. 15 is a cross-sectional plan view of the main portions illustrating a linkage between the first moving member 110 and the rack 175 when the top cover member M2 in the printer 1 has been maximally opened.

When the top cover member M2 is closed as shown in FIG. 7, the first engagement portion 113 of the first moving member 110 in the member moving mechanism 100 and the second engagement portion 177 of the rack 175 are spaced each other by the predetermined distance K, and do not engage with each other, as shown in FIG. 9.

Moreover, at this point in time, as shown in FIGS. 10 and 11, the second moving member 120 in the member moving mechanism 100 is maintained in the origin (home position) by a biasing force applied by the coil spring 182. As a result, the cutout 123 of the second moving member 120 faces the light transmission window 161 of the optical sensor 160. Therefore, the light emitted from the light transmission window 161 is not blocked, and detection of image density is normally performed by the optical sensor 160.

When the top cover member M2 in this state starts to be pivotally opened about the rotational shaft 172 as shown in FIG. 12, the gear segment 171 rotates. A rotational force of the gear segment 171 is transmitted through the pair of intermediate gears 176 to the rack 175. As a result, the rack 175 starts to move in the first positive direction D11. As shown in FIG. 13, the first engagement portion 113 of the first moving member 110 and the second engagement portion 177 of the rack 175 gradually approach each other, but do not engage with each other until the rack 175 has started to move in the first positive direction D11 to travel the predetermined distance K.

When the top cover member M2 is about half opened and the rack 175 has moved the predetermined distance K, the first engagement portion 113 of the first moving member 110 engages with the second engagement portion 177 of the rack 175.

During a time period in which the rack 175 moves while the top cover member M2 is about half opened to maximally opened as shown in FIG. 14, the first engagement portion 113 and the second engagement portion 177 are maintained engaged as shown in FIG. 15.

As a result, the first moving member 110 in the member moving mechanism 100 moves in the first positive direction D11 in conjunction with movement of the rack 175.

In conjunction with the first moving member 110 moving in the first positive direction D11, the second moving member 120 moves in the second positive direction D21 via the belt member 130.

In conjunction with the second moving member 120 moving in the second positive direction D21, the wiper 190 moves in the same direction (the second positive direction D21) while touching the light transmission window 161 of the optical sensor 160, thereby cleaning the light transmission window 161.

Moreover, the coil spring 182 is stretched and extended as a result of the second moving member 120 moving in the second positive direction D21. As a result, a biasing force to move the second moving member 120 back in the second negative direction D22 is generated by the coil spring 182.

In addition, when the top cover member M2 is closed, the rack 175 moves back in the first negative direction D12 via the gear segment 171 and the pair of intermediate gears 176. At the same time, the second moving member 120 moves back in the second negative direction D22 due to the biasing force generated by the coil spring 182.

In conjunction with the second moving member 120 moving back in the second negative direction D22, the wiper 190 moves in the same direction (the second negative direction D22) while touching the light transmission window 161 of the optical sensor 160, thereby cleaning the light transmission window 161 again.

Furthermore, in conjunction with the second moving member 120 moving back in the second negative direction D22, the first moving member 110 is also caused to move (return) in the first negative direction D12 via the belt member 130. As a result, the first engagement portion 113 of the first moving member 110 and the second engagement portion 177 of the rack 175 are restored to being separated from each other and not engaging with each other as shown in FIG. 9.

According to the member moving mechanism 100 of the present embodiment, for example, the following effects are achieved.

The member moving mechanism 100 of the present embodiment includes: the first moving member 110 moving in the first positive direction D11 and the first negative direction D12; the second moving member 120 moving in the second positive direction D21 and the second negative direction D22 that are different from each of the first positive direction D11 and the first negative direction D12; the belt member 130 connecting the first moving member 110 and the second moving member 120; and the belt-member guiding member 140 restricting the moving direction of the belt member 130, and changing the moving direction of the belt member 130 at least once.

In this way, according to the member moving mechanism 100 of the present embodiment, it is possible to make it easier to avoid interference with various drive units and mechanisms such that the degree of freedom in installation of the belt member 130 is increased, by using the belt member 130 excellent in flexibility as a member for connecting the first moving member 110 and the second moving member 120. In addition, since the bending direction of the belt member 130 is easily known, it is easy to install the belt member 130 when the member moving mechanism 100 is assembled.

Moreover, the member moving mechanism 100 of the present embodiment further includes the coil spring 182 that applies a biasing force to the second moving member 120. In addition, the coil spring 182 permits the second moving member 120 to move in the second positive direction D21 via the belt member 130, in conjunction with the first moving member 110 moving in the first positive direction D11. Furthermore, the coil spring 182 generates a biasing force in a direction to cause the second moving member 120 to move in the second negative direction D22 in conjunction with the second moving member 120 moving in the second positive direction D21.

As a result, according to the member moving mechanism 100 of the present embodiment, it is possible to move the second moving member 120 in the second positive direction D21, simply by providing a driving part for moving the first moving member 110 in the first positive direction D11. Moreover, according to the member moving mechanism 100 of the present embodiment, it is possible to generate a biasing force to cause the second moving member 120 to move back in the second negative direction D22 by utilizing movement of the second moving member 120 in the second positive direction D21.

Therefore, it is possible to provide the simple and inexpensive structure of the driving part of the member moving mechanism 100 for moving the first moving member 110 and the second moving member 120 back and forth in the positive direction and the negative direction.

In the member moving mechanism 100 of the present embodiment, the belt member 130 has the first holes 131 and the second holes 132. The first moving member 110 has the first protrusions 112 that are inserted into the first holes 131. The second moving member 120 has the second protrusions 122 that are inserted into the second holes 132. Furthermore, the connection between the first moving member 110 and the belt member 130 is performed by the first protrusions 112 that are inserted into the first holes 131. The connection between the second moving member 120 and the belt member 130 is performed by the second protrusions 122 that are inserted into the second holes 132.

As a result, according to the member moving mechanism 100 of the present embodiment, it is possible to provide the simple connection in terms of structure and assembly between the first moving member 110 and the belt member 130, and between the second moving member 120 and the belt member 130. Therefore, it is possible to achieve reduction in the manufacturing cost of the entire member moving mechanism 100.

Moreover, the belt member 130 of the member moving mechanism 100 of the present embodiment is made of a plastic material, elastic material, or metallic material.

As a result, according to the member moving mechanism 100 of the present embodiment, it is possible to insert and dispose the belt member 130 in a small gap or the like by reducing the flexural radius of the belt member 130. Therefore, it is possible to reduce the size of the member moving mechanism 100 as much as possible, decreasing the space for installing the belt member 130.

In addition, the member moving mechanism 100 of the present embodiment further includes the rack 175 configured to move to give a force to cause the first moving member 110 to move in the first positive direction D11. The first moving member 110 has the first engagement portion 113, and the rack 175 has the second engagement portion 177 that engages with the first engagement portion 113. Furthermore, the first engagement portion 113 and the second engagement portion 177 are configured not to engage with each other when the rack 175 starts moving, and to engage with each other when the rack 175 has moved the predetermined distance.

Therefore, according to the member moving mechanism 100 of the present embodiment, a position of engagement between the first engagement portion 113 and the second engagement portion 177 is set in accordance with the travel distance of the rack 175. In this manner, it is possible to arbitrarily set the travel distance of the first moving member 110 even if the travel distance of the rack 175 is large.

Furthermore, the printer 1 of the present embodiment includes the member moving mechanism 100, the top cover member M2, the optical sensor 160, and the wiper 190. The wiper 190 is connected to the second moving member 120 of the member moving mechanism 100 and moves in conjunction with the second moving member 120 moving in the second positive direction D21, thereby cleaning the optical sensor 160. Moreover, the first moving member 110 of the member moving mechanism 100 moves in the first positive direction D11 in conjunction with opening of the top cover member M2.

Therefore, according to the printer 1 of the present embodiment, for example, it is possible to move the wiper 190 via the first moving member 110, the belt member 130 and the second moving member 120 of the member moving mechanism 100 in conjunction with opening and closing of the top cover member M2 of the printer 1 for replacement or the like of a toner cartridge. In addition, it is possible to perform cleaning of the light transmission window 161 of the optical sensor 160 by the wiper 190.

Since the optical sensor 160 is installed inside the apparatus main unit M, the number of times (frequency) required for cleaning of the light transmission window 161 is not so great. According to the present embodiment, the light transmission window 161 is cleaned in conjunction with opening and closing of the top cover member M2, which is generally performed more frequently than the number of times (frequency) required for cleaning of the light transmission window 161.

As a result, it is possible to eliminate a special moving mechanism for moving the wiper 190, and a mechanism for counting the number of times or frequency the cleaning is performed. Moreover, it is possible to perform cleaning of the light transmission window 161 of the optical sensor 160 securely and sufficiently.

Although a preferred embodiment has been described above, the present invention is not limited to the aforementioned embodiment, and can be carried out in various modes.

For example, in the present embodiment, the member moving mechanism 100 is applied to operation linked between the top cover member M2 and the wiper 190 in the printer 1; however, it is not limited to such application. The member moving mechanism 100 may be used for operations linked between the paper cassette and the wiper 190, etc.

The belt-member guiding member 140 may change the moving direction of the belt member 130 once, or three times or more.

The printer 1 has been described as the image forming apparatus of the present embodiment. However, it is not limited to the printer 1, and may include a copying machine, facsimile, multi-function device thereof, or the like.

What is claimed is:

1. A member moving mechanism, comprising:

a first moving member configured to move in a first direction, in a first positive direction and in a first negative direction opposite to the first positive direction of the first direction;

a second moving member configured to move in a second direction orthogonal to the first direction, in a second positive direction and in a second negative direction opposite to the second positive direction of the second direction;

a flat belt member configured to connect the first moving member and the second moving member, one end of the flat belt member being connected to the first moving member and the other end of the flat belt member being connected to the second moving member; and a belt-member guiding member of a fixed type configured to control a moving direction of the belt member and to change the moving direction of the belt member from the first direction to the second direction, wherein the belt-member guiding member comprises a first guiding member and a second guiding member each of which is in contact with at least one of a front surface and a back surface of the flat belt member, wherein the first guiding member is configured to change the moving direction of the belt member in a direction orthogonal to a width of the belt member from the first direction to a direction orthogonal to the first direction, and wherein the second guiding member is configured to change the moving direction of the belt member having been changed by the first guiding member to the second direction in a direction parallel to the width of the belt member.

2. The member moving mechanism according to claim 1, wherein the first guiding member is disposed to pinch the front surface and back surface of the belt member therebetween.

3. The member moving mechanism according to claim 1, further comprising a biasing member configured to apply a biasing force to the second moving member, wherein the biasing member permits the second moving member to move in the second positive direction via the belt member, in conjunction with the first moving member moving in the first positive direction, and the biasing member generates the biasing force to cause the second moving member to move in the second negative direction.

4. The member moving mechanism according to claim 1, wherein the belt member comprises a first hole and a second hole, the first moving member comprises a first protrusion to be inserted into the first hole, the second moving member comprises a second protrusion to be inserted into the second hole, the first moving member and the belt member are connected with each other by the first protrusion inserted into the first hole, and the second moving member and the belt member are connected with each other by the second protrusion inserted into the second hole.

5. The member moving mechanism according to claim 1, wherein the belt member is formed of a material comprising at least one of a plastic material, an elastic material, and a metallic material.

6. The member moving mechanism according to claim 1, further comprising a moving-force-giving member configured to move to apply a force to cause the first moving member to move in the first positive direction, wherein the first moving member comprises a first engagement portion, the moving-force-giving member comprises a second engagement portion configured to engage with the first engagement portion, and the first engagement portion and the second engagement portion are configured not to engage with each other when the moving-force-giving member starts moving, and to engage with each other when the moving-force-giving member has moved a predetermined distance.

7. The member moving mechanism according to claim 3, further comprising a moving-force-giving member configured to apply a force to cause the first moving member to move in the first positive direction, wherein the first moving member comprises a first engagement portion, the moving-force-giving member comprises a second engagement portion configured to engage with the first engagement portion, and the first engagement portion and the second engagement portion are configured not to engage with each other when the moving-force-giving member starts moving, and to engage with each other when the moving-force-giving member has moved a predetermined distance.

8. The member moving mechanism according to claim 4, further comprising a moving-force-giving member configured to move to apply a force to cause the first moving member to move in the first positive direction, wherein the first moving member comprises a first engagement portion, the moving-force-giving member comprises a second engagement portion configured to engage with the first engagement portion, and the first engagement portion and the second engagement portion are configured not to engage with each other when the moving-force-giving member starts moving, and to engage with each other when the moving-force-giving member has moved a predetermined distance.

9. The member moving mechanism according to claim 5, further comprising a moving-force-giving member configured to move to apply a force to cause the first moving member to move in the first positive direction, wherein the first moving member comprises a first engagement portion, the moving-force-giving member comprises a second engagement portion configured to engage with the first engagement portion, and the first engagement portion and the second engagement portion are configured not to engage with each other when the moving-force-giving member starts moving, and to engage with each other when the moving-force-giving member has moved a predetermined distance.

* * * * *